US012677933B2

(12) United States Patent
Kassa

(10) Patent No.: US 12,677,933 B2
(45) Date of Patent: Jul. 14, 2026

(54) TOOTHBRUSH ASSEMBLY

(71) Applicant: Shewakena Kassa, Los Angeles, CA (US)

(72) Inventor: Shewakena Kassa, Los Angeles, CA (US)

( * ) Notice: Subject to any disclaimer, the term of this patent is extended or adjusted under 35 U.S.C. 154(b) by 378 days.

(21) Appl. No.: 18/454,548

(22) Filed: Aug. 23, 2023

(65) Prior Publication Data

US 2024/0065427 A1 Feb. 29, 2024

Related U.S. Application Data

(60) Provisional application No. 63/373,245, filed on Aug. 23, 2022.

(51) Int. Cl.

| | |
|---|---|
| ***A46B 11/00*** | (2006.01) |
| ***A46B 5/00*** | (2006.01) |
| ***A46B 15/00*** | (2006.01) |
| ***A46B 17/04*** | (2006.01) |

(52) U.S. Cl.

CPC ..... *A46B 11/0037* (2013.01); *A46B 5/0095* (2013.01); *A46B 11/0062* (2013.01); *A46B 15/0044* (2013.01); *A46B 15/0071* (2013.01); *A46B 15/0081* (2013.01); *A46B 15/0097* (2013.01); *A46B 17/04* (2013.01); *A46B 2200/1066* (2013.01)

(58) Field of Classification Search

CPC ..... A46B 15/0071; A46B 15/0073; A46B 15/0081; A46B 15/0097; A46B 15/0036; A46B 15/0044; A46B 15/0095; A46B 17/04; A46B 11/0037; A46B 11/0062; A46B 5/0095

See application file for complete search history.

(56) References Cited

U.S. PATENT DOCUMENTS

| | | | | |
|---|---|---|---|---|
| 2,468,298 A * | 4/1949 | Kahn | A46B 15/0071 | 132/309 |
| 2,717,101 A * | 9/1955 | Van Handel | A46B 11/0024 | 222/327 |
| 3,325,847 A * | 6/1967 | Meranto | A46B 17/04 | 15/184 |
| 5,636,933 A | 6/1997 | Vizsolyi | | |

(Continued)

OTHER PUBLICATIONS

Clarivate Analytics copyrighted translation of KR20090105197A; publication date Oct. 7, 2009 (Year: 2009).*

*Primary Examiner* — Edelmira Bosques
*Assistant Examiner* — Sarah Woodhouse

(57) ABSTRACT

A multipurpose toothbrush that has a handle, toothpaste reservoir, button, a toothpaste hole, a tube, a head, a head cover, a tongue scraper, one or more legs, a floss compartment, and an indicator light. The toothpaste reservoir is fluidly connected to the toothpaste hole on the toothbrush head, and the button is operatively connected to the toothpaste reservoir. When the button is pushed upwards, the entire reservoir is forced upwards, and toothpaste is pushed through a tube, exiting the brush holes. The head cover may fold over the brush head when the brush is stored, and may fold into an indent on the toothbrush head when the brush is being used. The legs support the brush so that the brush may stand upright when not in use. The toothbrush head may detach freely from the handle to be cleaned or replaced.

5 Claims, 8 Drawing Sheets

(56) References Cited

U.S. PATENT DOCUMENTS

| | | | | |
|---|---|---|---|---|
| 6,685,375 | B1 * | 2/2004 | Crocker | A46B 11/0065 401/179 |
| 6,719,471 | B1 | 4/2004 | Giro | |
| 6,772,770 | B1 * | 8/2004 | Williams, Sr. | A46B 7/04 132/309 |
| 6,907,638 | B2 * | 6/2005 | Katz | A46B 5/00 248/688 |
| 7,246,400 | B2 | 7/2007 | Ryan | |
| 9,332,830 | B1 | 5/2016 | Thompson | |
| 2005/0111905 | A1 | 5/2005 | Glover | |
| 2006/0260635 | A1 * | 11/2006 | Dabney | A46B 15/0055 132/309 |
| 2007/0071541 | A1 * | 3/2007 | Vila | A46B 15/0081 401/270 |
| 2007/0183838 | A1 | 8/2007 | Umar | |
| 2009/0193599 | A1 | 8/2009 | Stein et al. | |
| 2012/0160261 | A1 | 6/2012 | Harden | |
| 2012/0204898 | A1 * | 8/2012 | Haley | A61C 15/046 132/309 |
| 2013/0000658 | A1 | 1/2013 | Nguyen et al. | |
| 2017/0086574 | A1 | 3/2017 | Mclellan | |
| 2019/0116968 | A1 * | 4/2019 | Curry | A46B 11/0041 |
| 2020/0107632 | A1 * | 4/2020 | Frand | A46B 15/0008 |
| 2022/0022638 | A1 | 1/2022 | Su | |

* cited by examiner

TOOTHBRUSH ASSEMBLY

FIELD OF THE INVENTION

The present invention relates generally to personal hygiene implements. Specifically the present invention is a multipurpose toothbrush assembly.

BACKGROUND OF THE INVENTION

Proper dental hygiene requires a large number of accessories, devices, and consumable products for proper hygiene to be achieved. This includes toothbrushes, tongue scrapers, dental floss, and toothpaste. Traveling with all these disparate pieces can also be troublesome. This combination can result in clutter and reduced storage space for users. As a result, there exists for a single device that combines all of the above hygiene implements into a single device.

The present invention aims to solve these problems by providing a single unified dental hygiene device, in the form of a toothbrush assembly. The toothbrush assembly may comprise a handle, a toothpaste reservoir, a button, a toothpaste hole, a tube, a toothbrush head, a toothpaste hole, a head cover, a cover indent, a tongue scraper, a scraper indent, one or more legs, a floss compartment, a floss cover, one or more floss receivers, and an indicator light. The toothbrush head may be detachably attachable to the handle to facilitate efficient replacement of the toothbrush head when one or more bristles wear out. The handle may comprise a toothpaste reservoir on the interior to store toothpaste. The button may be operatively connected to the toothpaste reservoir, such that when the button is pushed upwards, the bottom of the toothpaste reservoir is forced upwards. The tube is fluidly connected to the top of the toothpaste reservoir at one end, and to a toothpaste hole positioned on the toothbrush head on the other end. Thus, when a user pushed the button upwards, toothpaste is forced upwards from the toothpaste reservoir through the tube, and between the bristles. When the reservoir needs to be refilled, the toothbrush head is simply detached from the handle, such as by unscrewing the head from the handle. When the brush is not in use, the toothbrush head may be covered with a head cover. The head cover can be folded into a cover indent on the body when the brush is in storage. The tongue scraper is adapted to be stored in a scraper indent on the body of the toothbrush, ideally being hingedly connected to the body. The tongue scraper can be pulled out of the body and kept in place with a tensioning mechanism when in use, and then pressed back into the scraper indent for storage when not in use. A floss compartment may be located on the rear of the head of the toothbrush for storing dental floss. A floss cover may be hingedly connected to the head of the toothbrush, such that the floss cover can be flipped upwards to provide access to the dental floss to allow for easy refills or to adjust the floss. The floss cover may have one or more floss receivers. The floss receivers are adapted to receive and hold the dental floss to create a flosser. Once the flosser has been used, the floss can be pulled further through to remove dirty floss, and the dirty floss can be severed from the floss string by a cutting edge present on the floss cover. One or more legs present at the bottom of the brush allow the brush to stand freely without external assistance, enabling easier storage of the brush when not in use.

As described above, the toothbrush assembly is thus a multipurpose assembly to allow for easy storage and use of toothpaste, floss, a tongue scraper, and a toothbrush head.

The toothbrush assembly provides an efficient, compact, and travel-friendly solution for dental hygiene.

DETAIL DESCRIPTIONS OF THE INVENTION

Figure 1:
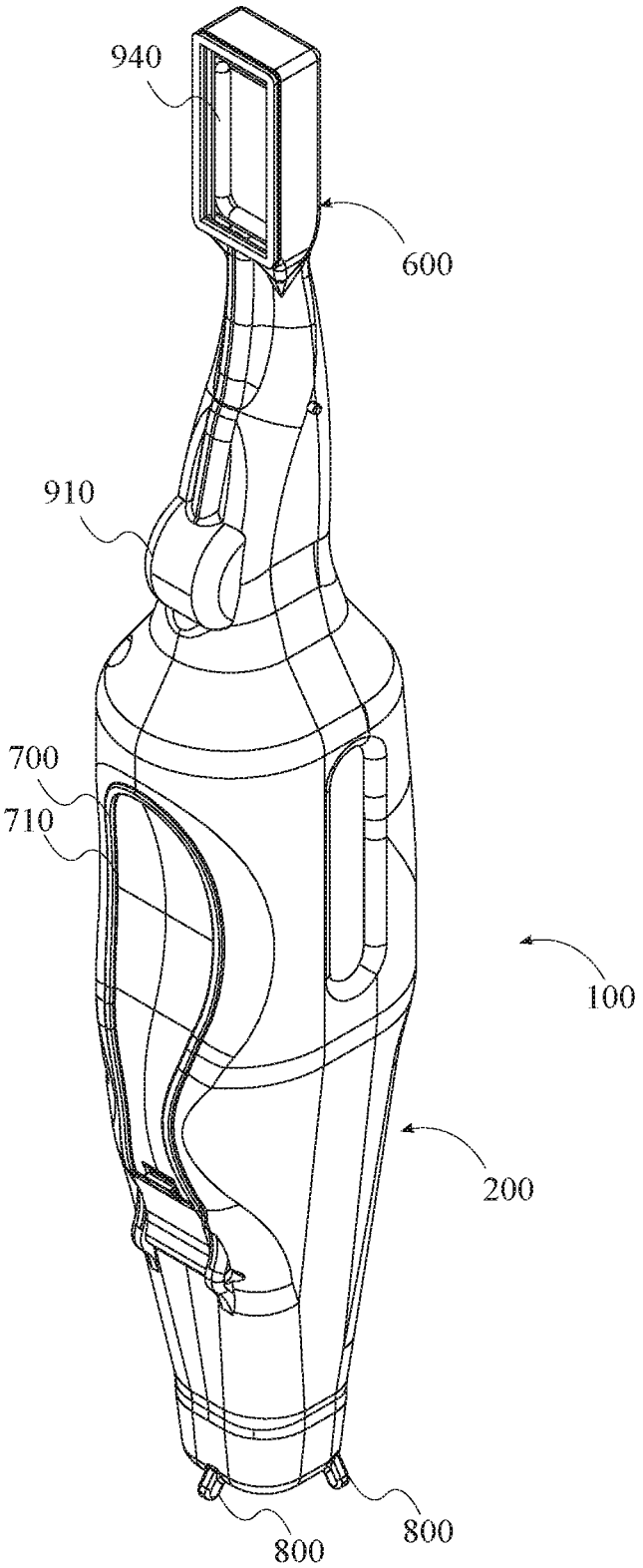
FIG. 1 is a front perspective view of the present invention.
Figure 2:
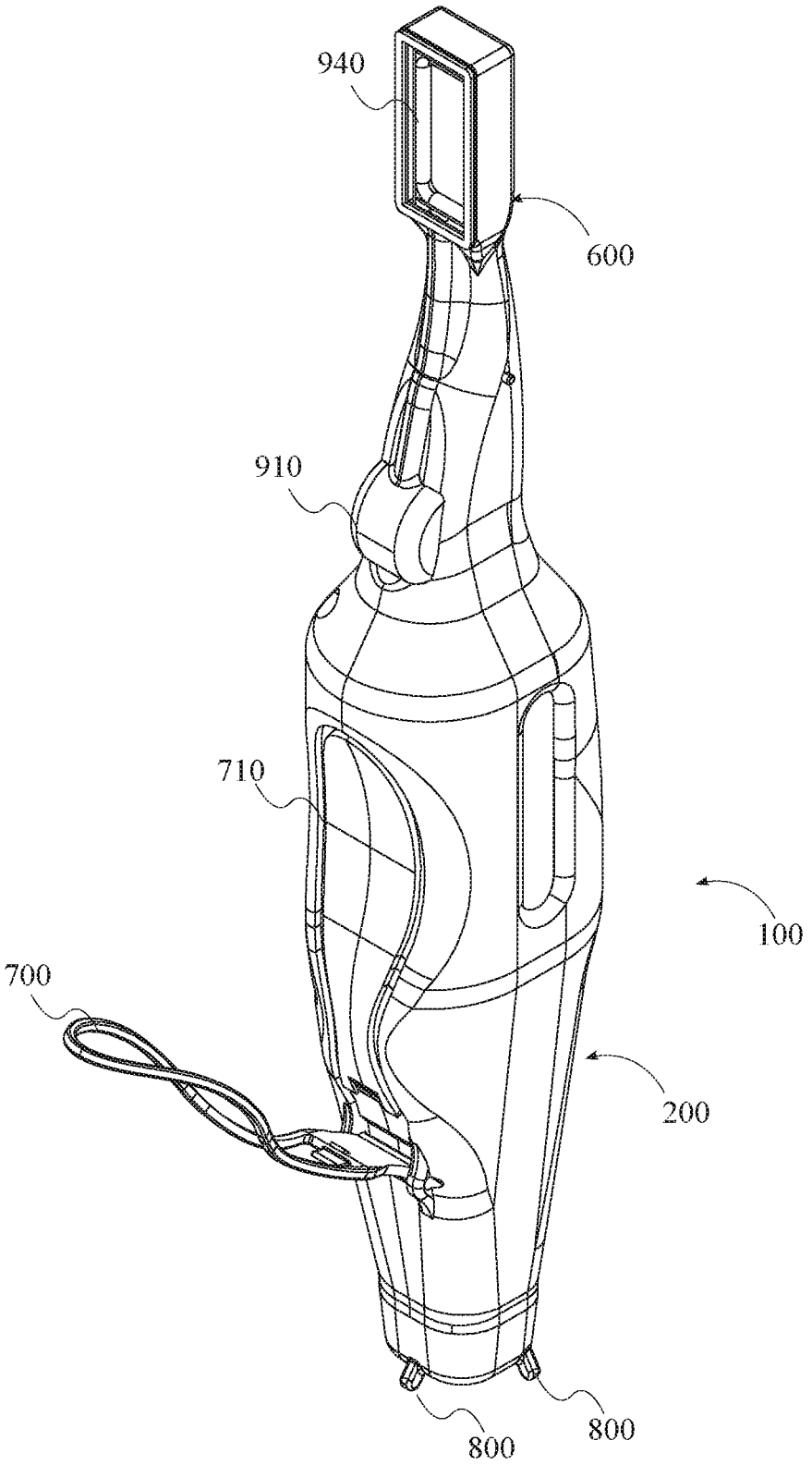
FIG. 2 is a front perspective view of the present invention, showing the tongue scraper being hinged outwards from the handle.

All illustrations of the drawings are for the purpose of describing selected versions of the present invention and are not intended to limit the scope of the present invention.

The definitions stated herein should be understood to control the definitions in these writings, unless otherwise explicitly stated. It should be understood that any reference to the words "a" or "an" also include reference to more than one of the components, including but not limited to "one or more", "a plurality of", and "at least one". The words "fluidly connected" should be understood to mean that the relevant components are connected to permit transit of a liquid or gas between them. Any reference to a fastener or to a connection between two components should be understood to include any means of connection or fastening well known in the art, the components either being integral to each other or being connected via any fastener well-known in the art, including but not limited to screw threading, press-fitting, adhesive, hook-and-loop, screws, nuts, or bolts. It should be understood that the below descriptions are intended to represent the ideal embodiment, and components may be swapped and changed in positioning, shape, size, material, and configuration without departing from the spirit and scope of the present invention.

Referring now to the figures, as seen in FIGS. 1-8, The toothbrush assembly 100 may comprise a handle 200, a toothpaste reservoir 310, a button 300, a toothpaste hole 400, a tube 500, a toothbrush head 600, a toothpaste hole 400, a head cover 610, a cover indent 620, a tongue scraper 700, a scraper indent 710, one or more leg 800, a floss compartment 900, a floss cover 910, one or more floss receivers, and an indicator light 1000.

Referring now to FIGS. 1-6, the handle 200 may be roughly cylindrical in shape. In the ideal embodiment, the interior of the handle 200 is hollow, such that the toothpaste reservoir 310 may be positioned on the interior of the handle 200. In the ideal embodiment, the scraper indent 710 and button 300 are positioned on the exterior of the handle 200. The top of the handle 200 may be adapted with screw threading, such that the top of the handle 200 is adapted to detachably attach to the bottom of the toothbrush head 600. In one embodiment, an indicator light 1000 may be positioned on the bottom of the handle 200. The top of the toothpaste reservoir 310 may be adapted to be in fluid connection with the bottom of the tube 500. The top of the tube 500 may be adapted to be in fluid connection with the toothbrush head 600, such that when the toothpaste reservoir 310 is actuated—for example, if the toothpaste reservoir 310 is raised—toothpaste will be forced from the toothpaste reservoir 310, into the tube 500, and out the toothpaste hole 400 in the toothbrush head 600.

Figure 3:
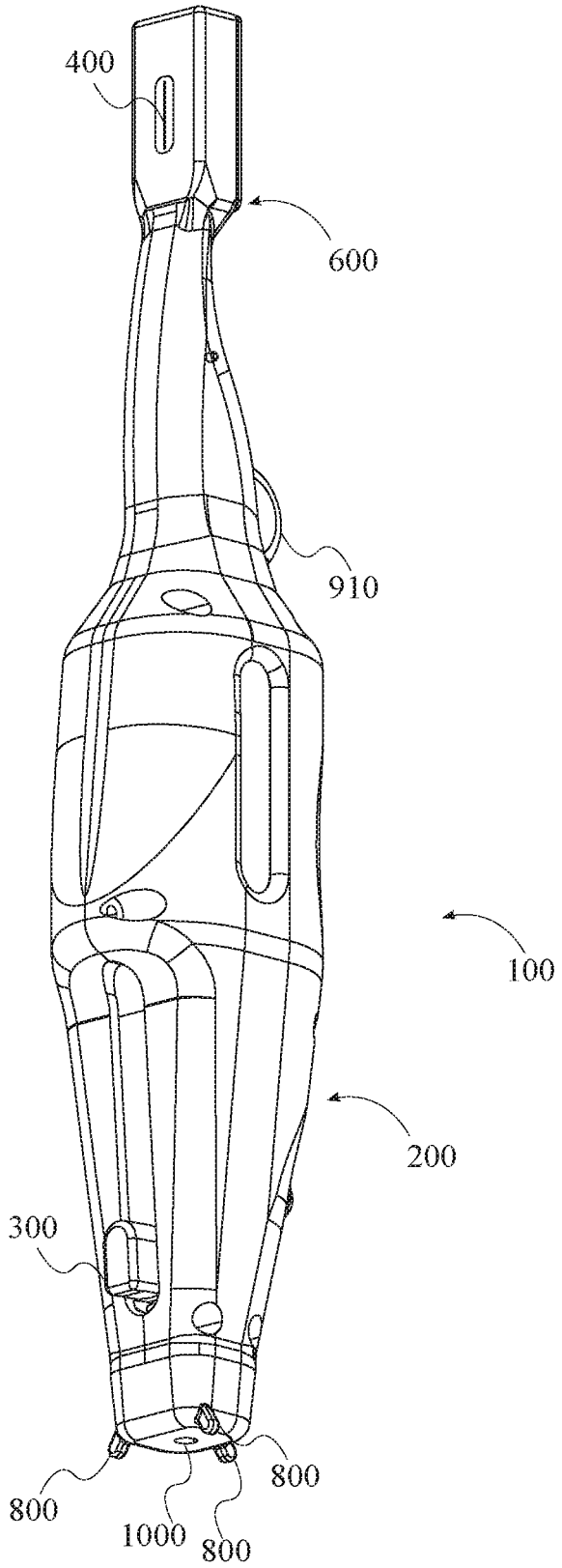
FIG. 3 is a back perspective view of the present invention.
Figure 6:
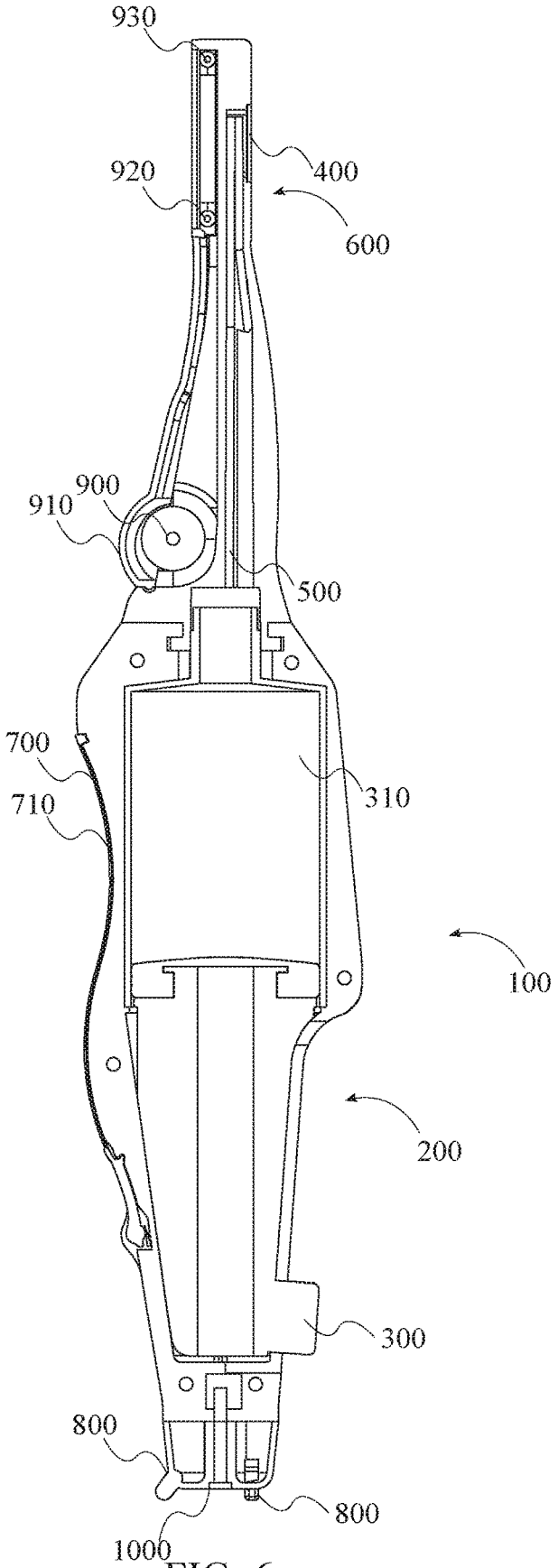
FIG. 6 is a cross sectional view of FIG. 5 taken along line A-A.
Figure 7:
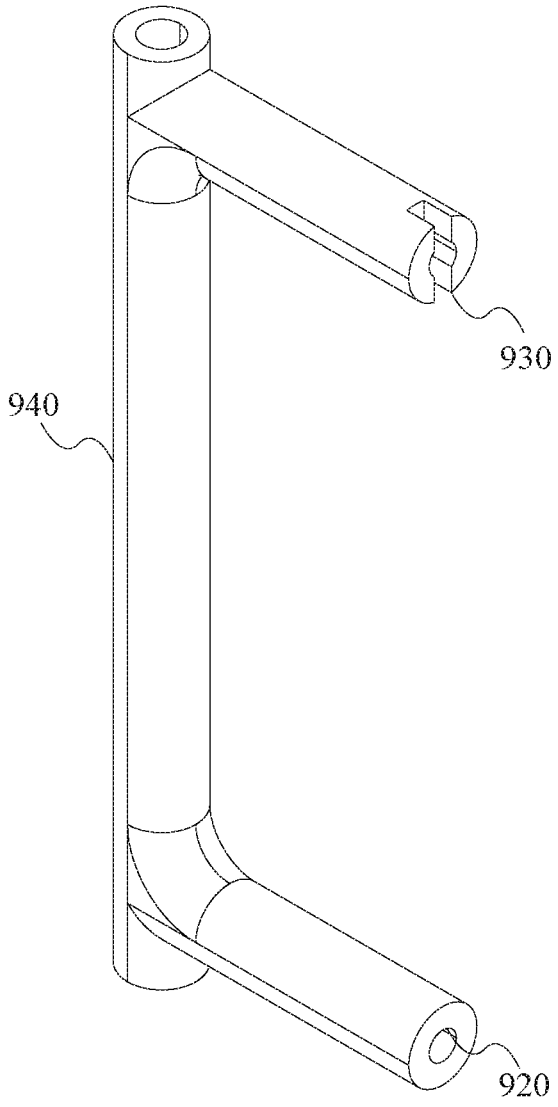
FIG. 7 is an exemplary view of the flosser, showing the floss receivers.

As seen in FIGS. 3 and 6, the button 300 may be positioned on the exterior of the handle 200. The button 300 may be operatively connected to the toothpaste reservoir 310, such that the toothpaste reservoir 310 may mimic any movement of the button 300. In the ideal embodiment, the button 300 may be positioned such that it is slidably connected to the handle 200, being able to slide vertically along the exterior of the handle 200. When the button 300 is slid upwards, the bottom of the reservoir is thus raised. When the button 300 is slid downwards, the bottom of the reservoir is thus lowered. This configuration allows a user to deploy toothpaste from the reservoir through the tube 500 by sliding the button 300 upwards. Once the reservoir is depleted, the reservoir can be lowered to the bottom and refilled. In some embodiments, a stopper spring may be present at the bottom of the interior of the handle 200 to prevent the reservoir from forcefully impacting the bottom of the interior of the handle 200 when the reservoir is lowered. Other actuation mechanisms for the button 300 besides sliding are within the spirit and scope of the present invention. In some embodiments, the button may be connected to a plunger, the plunger being operatively connected to the toothpaste reservoir 310. The plunger may be adapted to slide up and down the interior of the handle to move the reservoir 310 as the button is actuated.

Referring now to FIGS. 1-2, and FIGS. 4-6, the tongue scraper 700 may be positioned on the handle 200, ideally be hingedly connected to the handle 200. The tongue scraper 700 may be adapted to slot into the scraper indent 710, the scraper indent 710 being positioned on the exterior of the handle 200. In some embodiments, a tensioning mechanism, such as a tensioning spring, may be adapted to keep the tongue scraper 700 in place when the tongue scraper 700 is moved outwards from the brush handle 200 using the hinged connection. The tongue scraper 700 may thus be pulled outwards from the scraper indent 710 using the hinged connection, kept in position by the tensioning mechanism when in use, and then pressed back into the scraper indent 710 for storage. In the ideal embodiment, the tongue scraper 700 may be roughly u-shaped. In the ideal embodiment, the tongue scraper 700 may be adapted to fold outwards at about a 60-degree angle from the handle 200 before being held in place by the tensioning mechanism.

Referring now to FIGS. 1-6, one or more leg 800 may be positioned on the bottom of the handle 200. The legs 800 may be static and unmoving, or may be telescoping or otherwise capable of sliding into and out of one or more leg 800 indents in the handle 200. In the ideal embodiment, the legs 800 are positioned equidistant from each other around the exterior perimeter of the bottom of the handle 200 to support the brush assembly's weight equally.

Referring now to FIGS. 3 and 6, in some embodiments, one or more electronic components or sensors may be present on the toothbrush assembly 100. The indicator light 1000 may comprise an LED light positioned on the bottom of the handle 200. The indicator light 1000 may be electrically connected to any electronic sensor or components, and may be adapted to turn on and off, change colors, or produce any other visual or audio signal to indicate some state of any component of the toothbrush assembly 100. For example, if a battery is present, the indicator light 1000 may be adapted to turn on when the battery is low.

Figure 4:
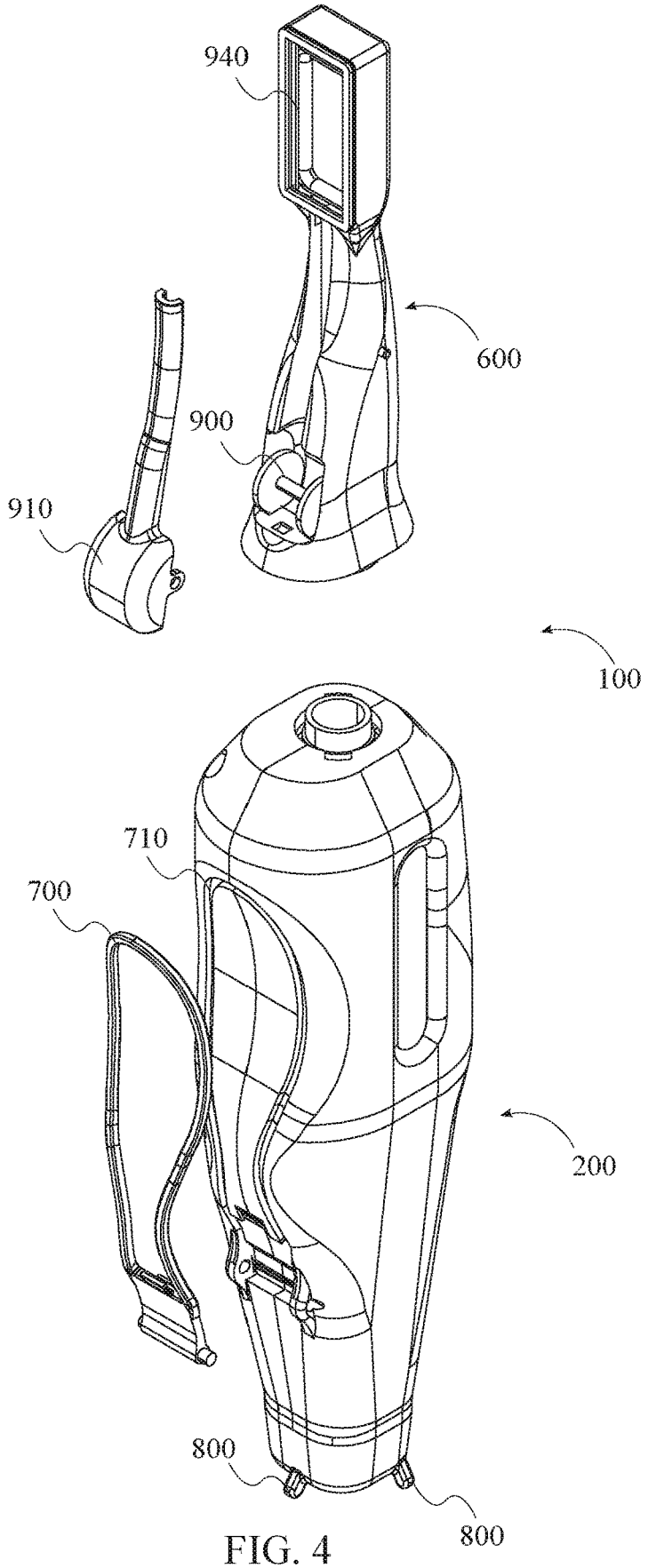
FIG. 4 is front perspective exploded view of the present invention.
Figure 5:
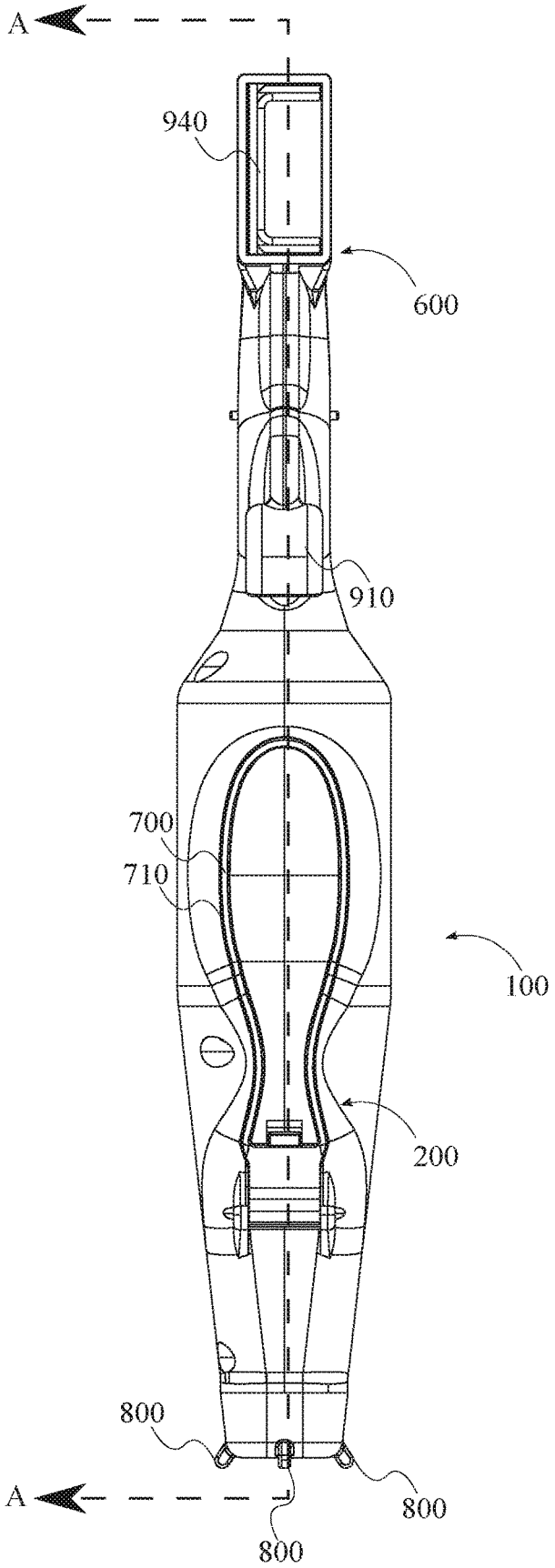
FIG. 5 is a front view of the present invention.

As shown in FIG. 4, the toothbrush head 600 may be detachable from the handle 200. In the ideal embodiment, the toothbrush head 600 is detachable from the handle 200 via screw threading, such that the toothbrush head 600 may screw onto threading present on the toothbrush handle 200, though other attachment mechanism are contemplated. The toothbrush head 600 may further comprise the floss compartment 900, the floss cover 910, the head cover 610, the cover indent 620, and the toothpaste hole 400.

The floss compartment 900 may be a hollow indent positioned on the back of the toothbrush head 600. The floss compartment 900 is adapted to receive dental floss, such as receiving a roll or string of floss, or by having a replaceable spool upon which thread can be placed. A floss cover 910 may be hingedly attached to the floss compartment 900, the head cover 610 being adapted to cover the floss compartment 900 for storage, and flipping upwards to allow access to the interior of the floss compartment 900 when not in storage to allow a user to access any floss to replace or change the floss.

Referring now to FIGS. 1-2 and 4-7, the floss cover 910 or a flosser 940 may comprise one or more floss receivers. Each floss receiver may comprise an indent in the floss cover 910 or flosser 940 that is adapted to receive a string of floss. In the ideal embodiment, the one or more floss receivers may comprise a first receiver 920 and a second receiver 930. In this configuration, floss is adapted to thread through both the first receiver 920 and the second receiver 930, being tensioned between the receivers. This creates a flosser device that may be used directly to floss the user's teeth. Once the floss is used, the floss may be pulled through the second receiver 930, and the dirty floss may be cut off on a sharp edge on the floss cover 910. This configuration allows easy replacement of the floss until the floss must be replaced, and enables the floss cover 910 to be used as a flosser. In some embodiments, the floss cover 910 may comprise one or more posts, the top of each post being adapted with a floss receiver to form the flosser.

As shown in FIGS. 3 and 6, the toothbrush head 600 may further comprise a toothpaste hole 400. The toothpaste hole 400 is adapted to be in fluid connection to the tube 500, such that the tube 500 fluidly connects the toothpaste hole 400 to the toothpaste reservoir 310. As described above, when the user actuates the button 300, toothpaste may be forced from the toothpaste reservoir 310, through the tube 500, and out the toothpaste hole 400. In the ideal embodiment, the toothpaste hole 400 may be positioned in proximity to one or more toothbrush bristles located on the toothbrush head 600, such that toothpaste is applied to the bristles when the button 300 is actuated. In the ideal embodiment, the toothpaste hole 400 may comprise a plurality of toothpaste holes 400, each of the plurality of toothpaste holes 400 being in fluid connection with the tube 500.

Figure 8:
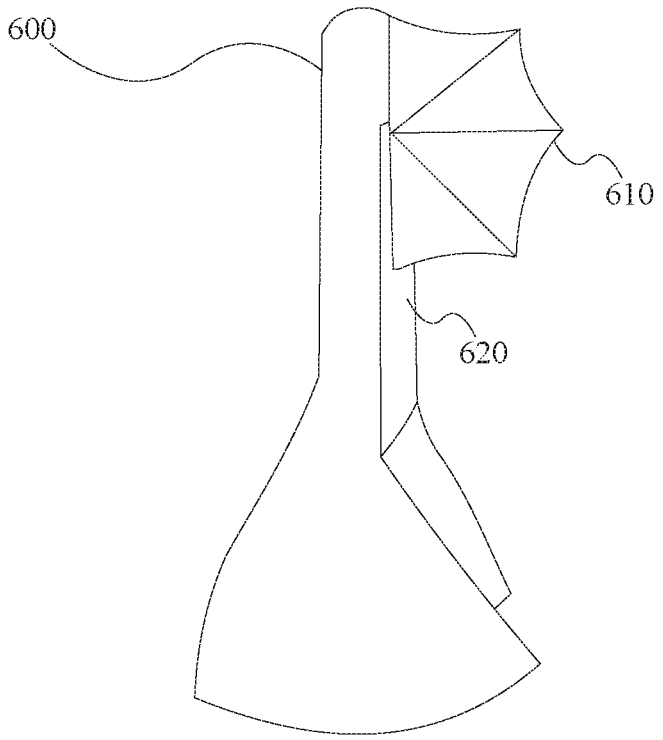
FIG. 8 is an exemplary view of the toothbrush cover and cover indent.

Referring now to FIG. 8, the toothbrush head 600 may further comprise a toothbrush cover and a cover indent 620. The cover indent 620 may comprise a recess on the toothbrush head 600 that is adapted to be of a size and shape to receive the toothbrush cover. The toothbrush cover may be adapted to fold into the cover indent 620 for storage. The toothbrush cover may be adapted to fold out of the indent to protect the toothbrush head 600, covering the head and any bristles to protect the toothbrush head 600 from grime and bacteria when the toothbrush assembly 100 is in storage. Ideally, the toothbrush cover is made of a material and of a configuration to fold or compress into the cover indent 620 to save space.

Although the invention has been explained in relation to its preferred embodiment, it is to be understood that many other possible modifications and variations can be made without departing from the spirit and scope of the invention.

I claim:

1. A toothbrush assembly comprising:

a handle;

a toothpaste reservoir, a button;

a toothpaste hole;

a tube;

a toothbrush head;

a floss compartment;

a floss cover;

the button being operatively connected to the toothpaste reservoir;

the toothpaste hole comprising a plurality of toothpaste holes;

the toothpaste reservoir being located inside the handle;

the toothpaste reservoir being in fluid connection with the tube;

the tube being in fluid communication with the toothpaste hole;

the toothpaste hole being positioned on the toothbrush head;

the button being slidably attached to the handle;

the reservoir is adapted to elevate when the button is pushed upwards;

the toothbrush head being detachably attachable to the handle;

wherein the toothbrush head is adapted to screw into a screw thread on the handle;

the reservoir is adapted to move downwards when the button is pushed downwards;

the floss cover further comprising a first floss receiver and a second floss receiver;

the floss cover being hingedly connected to the floss compartment; and the floss compartment being positioned on the toothbrush head.

2. The toothbrush assembly of claim 1, further comprising:

a head cover;

a cover indent;

the head cover being adapted to fold into the cover indent;

a tongue scraper;

a scraper indent;

the tongue scraper being hingedly attached to the handle; and the tongue scraper being adapted to slot into the scraper indent.

3. The toothbrush assembly of claim 1, further comprising:

a leg;

the leg further comprising a plurality of legs; and the plurality of legs being distributed equidistant from each other along the bottom of the handle.

4. The toothbrush assembly of claim 1, further comprising:

an indicator light; and the indicator light being positioned on a bottom of the handle.

5. A toothbrush assembly comprising:

a handle;

a toothpaste reservoir;

a button;

a toothpaste hole;

a tube;

a toothbrush head;

a head cover;

a cover indent;

a tongue scraper;

a scraper indent;

a leg;

a floss compartment;

a floss cover;

the floss cover further comprising a first floss receiver and a second floss receiver;

an indicator light;

the floss cover being hingedly connected to the floss compartment;

the toothpaste reservoir being located inside the handle;

the toothpaste reservoir being in fluid connection with the tube;

the tube being in fluid communication with the toothpaste hole;

the toothpaste hole being positioned on the toothbrush head;

the button being slidably attached to the handle;

the button being operatively connected to the toothpaste reservoir, such that the reservoir is adapted to elevate when the button is pushed upwards and the reservoir is adapted to move downwards when the button is pushed downwards;

the head cover being adapted to fold into the cover indent;

the tongue scraper being hingedly attached to the handle;

the tongue scraper being adapted to slot into the scraper indent;

the leg further comprising a plurality of legs;

the plurality of legs being distributed equidistant from each other along a bottom of the toothbrush assembly;

the floss compartment being positioned on the toothbrush head;

the indicator light being positioned on the bottom of the handle;

the toothbrush head being detachably attachable to the handle;

the toothpaste hole comprising a plurality of toothpaste holes; and wherein the toothbrush head is adapted to screw into a screw thread on the handle.

* * * * *